United States Patent [19]

Siegel

[11] Patent Number: 5,001,465

[45] Date of Patent: Mar. 19, 1991

[54] CRANE BOOM ELECTROSTATIC . . . ALARM

[76] Inventor: Vernon H. Siegel, 5120 Brook Field Ln., Clarence, N.Y. 14031

[21] Appl. No.: 515,356

[22] Filed: Apr. 30, 1990

Related U.S. Application Data

[63] Continuation of Ser. No. 143,207, Jan. 11, 1988, abandoned, which is a continuation of Ser. No. 80,166, Jul. 29, 1987, abandoned, which is a continuation of Ser. No. 4,269, Jan. 6, 1987, abandoned, which is a continuation of Ser. No. 712,628, Mar. 18, 1985, abandoned.

[51] Int. Cl.[5] ..... G083 21/00

[52] U.S. Cl. ..... 340/685; 324/72.5; 340/662; 340/664

[58] Field of Search ..... 340/685, 662, 664; 324/72.5

[56] References Cited

U.S. PATENT DOCUMENTS 2,615,969 10/1952 Albrecht ..... 340/685

4,064,997 12/1977 Holland et al. ..... 340/685

*Primary Examiner*—Glen R. Swann, III

*Attorney, Agent, or Firm*—William H. McNeill

[57] ABSTRACT

A plurality of electrostatic field proximity sensors are mounted upon a crane boom. The sensors are capacitive elements and include an antenna. The sensors are electrically connected in parallel with a single wire. A summing amplifier is coupled to the sensors for detecting changes in flux fields, which changes could signal a dangerous condition. The sensors can comprise an electrically insulating body having first and second ends with a conductive member attached to one of the ends. A mounting means is provided at the other one of the ends. A resistor can be electrically connected between the ends to discharge excess static charge and to allow detection of missing sensors.

14 Claims, 3 Drawing Sheets

CRANE BOOM ELECTROSTATIC . . . ALARM

This is a continuation of copending application Ser. No. 07/143,207, filed on Jan. 11, 1988, which is a continuation of Ser. No. 07/080,166, filed July 29, 1987, which is a continuation of Ser. No. 07/004,269, filed Jan. 6, 1987, which is a contiuation of Ser. No. 06/712,628, filed Mar. 18, 1985, all abandoned.

TECHNICAL FIELD

This invention relates to proximity sensors and more particularly to such sensors for use on the boom of cranes for detecting the presence of electrostatic fields, such as those surrounding high tension lines. The sensors can trigger an alarm to warn the crane operator of the immenent danger of high electric currents.

BACKGROUND ART

It is frequently necessary for men and machines to work in the vicinity of hazardous electric fields. For example, mobile cranes engaged in construction or maintenance of power distribution systems. Federal agencies and some states have regulations that such equipment should not be operated within 10 feet of such energized power lines. However, operator misjudgement, forgetfulness, equipment malfunction, etc. sometimes allows equipment to come into contact with such power lines. While these accidents are rare, and constitute a small percentage of total crane incidents, they contribute to a large percentage of fatalities.

Several types of sensing or monitoring equipment have been devised to help prevent such accidents. One type employs a computer model of the relationship of the crane and its boom and jibs to the power line. This requires all moveable portions of the crane to be equipped with the appropriate sensors to relay the positions of the crane's components to the computer. Also, the exact geometry of the terrain and power lines must be accurately known and entered into the computer. Not only is this expensive, but this solution also requires a large degree of cooperation and attention of the crane operator.

Other systems employ sensing of the electrostatic or electromagnetic fields around the power lines to provide an alarm when the crane penetrates the field to a preset distance, Sensing of the electromagnetic field is simple, but is not practical because the magnetic field is produced by current flow in the lines. This current flow can change through wide values from moment to moment as load conditions vary.

Electrostatic proximity detectors now in use generally employ either a long sensing wire stretched along the crane boom or a point sensor mounted at some point on the boom. The distributed sensor will provide coverage along the side of the boom facing the electric field but will be "shadowed" on the other sides of the boom. Significant variations in sensitivity will be introduced by changing the length of the boom or by changing the orientation of the boom in relation to the power lines.

Tests have been conducted with distributed wire antennas and with a point contact probe mounted on a crane boom. If a crane is restricted to limited motions near an energized power line, then either system offers some warning as to hazardous approach. If, however, the crane were granted full mobility, such as by changing the orientation of the boom from perpendicular to horizontal with respect to the power line, or if the crane boom were moved from under the power line to over the power line, then the protection offered would change drastically. This occurs since the sensitivity of the antenna is affected by the orientation of and shielding by the boom, and distortion of the field by the cab, etc.

If multiple sensors are utilized, then the changes due to orientation and shadowing can by minimized. However, wiring of each sensor to the detector is expensive and difficult since some cranes have telescoping booms or jibs, and take-up reels are necessary to wind up the sensor wires. Additionally, the end of some booms (the end most in need of protection) usually has pulleys for the crane cable and is not suitable for the placement of sensor antennas.

DISCLOSURE OF THE INVENTION

It is, therefore, an object of the invention to obviate the disadvantages of the prior art.

It is another object of the invention to enhance proximity sensors.

It is yet another object of the invention to provide an alarm system for sensing electrostatic fields.

It is still another object of the invention to provide such alarm systems suitable for use on cranes.

These objects are accomplished, in one aspect of the invention, by the provision of an alarm system for sensing dangerous electrostatic fields in the area of an electrically conductive element which comprises a plurality of electrostatic sensors mounted upon the element. Each of the sensors comprises an insulating body having an electrically conductive member at one end to intercept an electric field. Mounting means are provided on the sensors for attachment to the element. The sensors are arranged in sets about the element and are electrically connected in parallel with a single wire. A capacitive summing amplifier is coupled to the sensors and a filter is coupled to the summing amplifier. A variable amplifier is coupled to the filter, a detector is coupled to the variable amplifier, and an alarm is coupled to the detector.

In an alternate embodiment a resistor associated with each sensor may be used to indicate if a sensor is missing or disconnected.

A novel sensor is also provided. The sensor comprises an electrically insulating body having first and second ends having electrically conductive members at each of the ends. Mounting means are attached to the first end and an antenna is connected to the second end. A resistor is electrically connected between the first end and the antenna.

The sensor and its system provided an improvment over the prior art. The sensor is simple and inexpensive to construct and is adjustable within wide ranges to fit a variety of conditions. The system, utilizing sets of sensors coupled in parallel, obviates the shadowing problems encountered by prior art systems.

DESCRIPTION OF THE BEST MODE

For a better understanding of the present invention, together with other and further objects, advantages and capabilities thereof, reference is made to the following disclosure and appended claims taken in conjunction with the above-described drawings.

Figure 1:
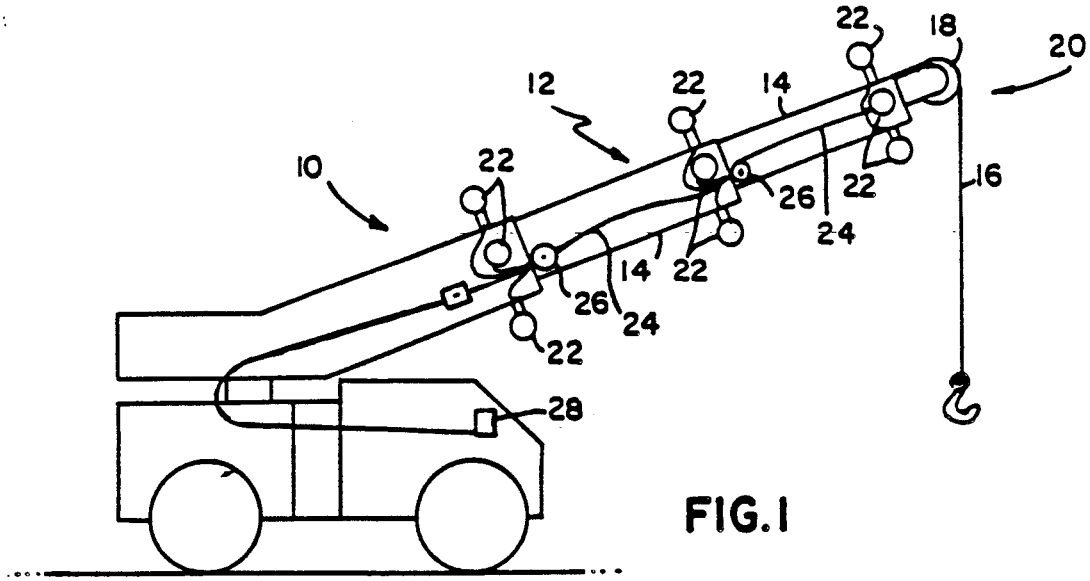
FIG. 1 is a diagrammatic view of a mobile crane with a telescoping boom employing the invention.

Referring now to the drawings with greater particularly, there is shown in FIG. 1 a mobile crane 10 carrying a boom 12 that may have one or more telescoping sections 14. The crane cable 16 usually passes over a pulley 18 located near the end of the boom. Large construction cranes may have a movable jib 20 located at the end of the boom 12 that will allow another degree of freedom of movement and provide for even further extension.

Sensors 22 are mounted on each side of each section 14 of the boom 12. In practice it has been found that six or eight sensors usually are sufficient to provide the desired pattern of protection.

The sensors 22 are connected to a single wire 24 and this in turn is connected, via take-up reels 26, to control panel 28. Control panel 28 contains adjustments for the sensitivity and provides alarms to indicate if sensors are missing or if the preset sensitivity has been exceeded. Single wire 24 may be a single conductor with the crane body acting as a ground reference. However, single wire 24 is preferably a shielded wire to prevent spurious ignition or electrical noise pickup and the shield of wire 24 will insure the ground reference of each sensor is at the same potential.

Figure 2:
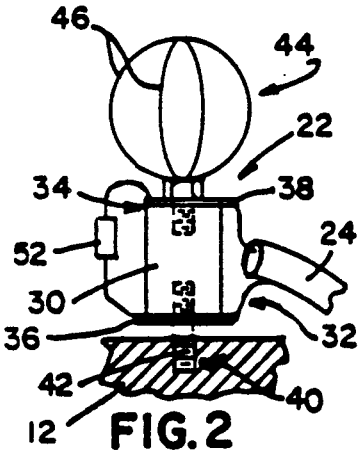
FIG. 2 is an elevational view of an embodiment of a sensor.

FIG. 2 shows a first form of a capacitive sensor 22 that exhibits a constant sensitivity with changes in orientation. The sensor 22 comprises an electrically insulating body 30 having a first end 32 and a second end 34. The first end 32 is provided with an electrically conductive member 36, such as a metal washer, and the second end 34 is also provided with a similar electrically conductive member 38. The first end 32 is provided with mounting means 40, e.g., a threaded stud 42, and an electrically conductive antenna 44 is affixed to the second end 34. The antenna 44 is preferably a hollow metal sphere; but may be less expensively constructed, as shown, with spherically arrayed wires 46.

Figure 3:
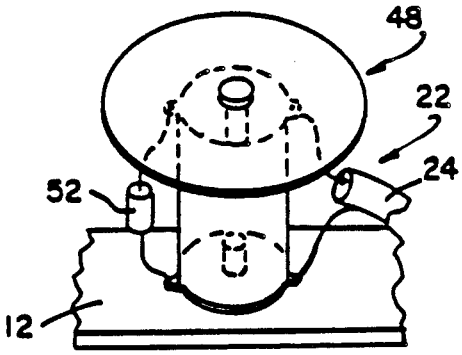
FIG. 3 is a perspective view of an alternate embodiment of a sensor.
Figure 4:
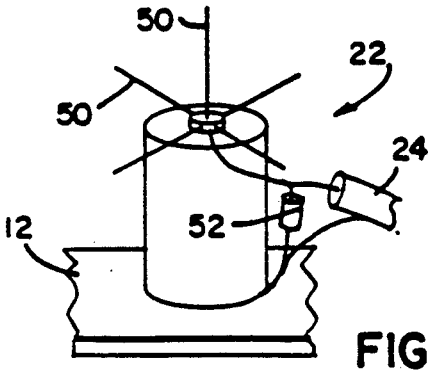
FIG. 4 is a perspective view of yet another embodiment of a sensor.

Alternatively, the antenna 44 can be in the form of a metal or conductive rubber disc 48 (FIG. 3) or an X,Y, Z array of wires 50 (FIG. 4).

Figure 5:
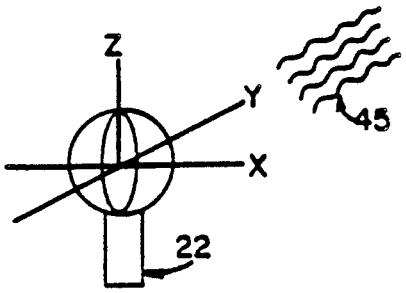
FIG. 5 is a diagrammatic view of a sensor and detectable flux field.

The dimensions of the antenna 44, in the X and Y directions, as shown in FIG. 5, should be approximately equal so that as the sensor 22 is tilted in relation to a flux field 45, the intercept area and the height above the electrically conductive element 12 remains approximately constant.

A resistor 52 is connected between conductive members 36 and 38 (and thus, antenna 44 and boom 12). The resistor 52, which can have a value of 1 megohms, serves two purposes. First, it serves to drain off excess static charge buildup and, second, by making the resistor 52 a known value, it can be detected if one or more sensors 22 have been lost or disconnected, as will be explained hereinafter.

The mounting of the sensors 22 is also variable. If one sensor 22 is made larger or mounted higher above surface 12 than the rest of the sensors, then the sensitivity available from this sensor will exceed the sensitivity of the remainder of the sensors. If the signals of the sensors 22 are summed as indicated below, then the detection zone around the different sensor will be greater than the others. This procedure allows the total protective zone to be altered or shaped as desired. For example, conditions may not permit a sensor 22 to be mounted at the extreme end of boom 12 since it might interfere with the rigging cable. In such a situation, a larger sensor mounted further back can provide adequate coverage for the tip.

Figure 6:
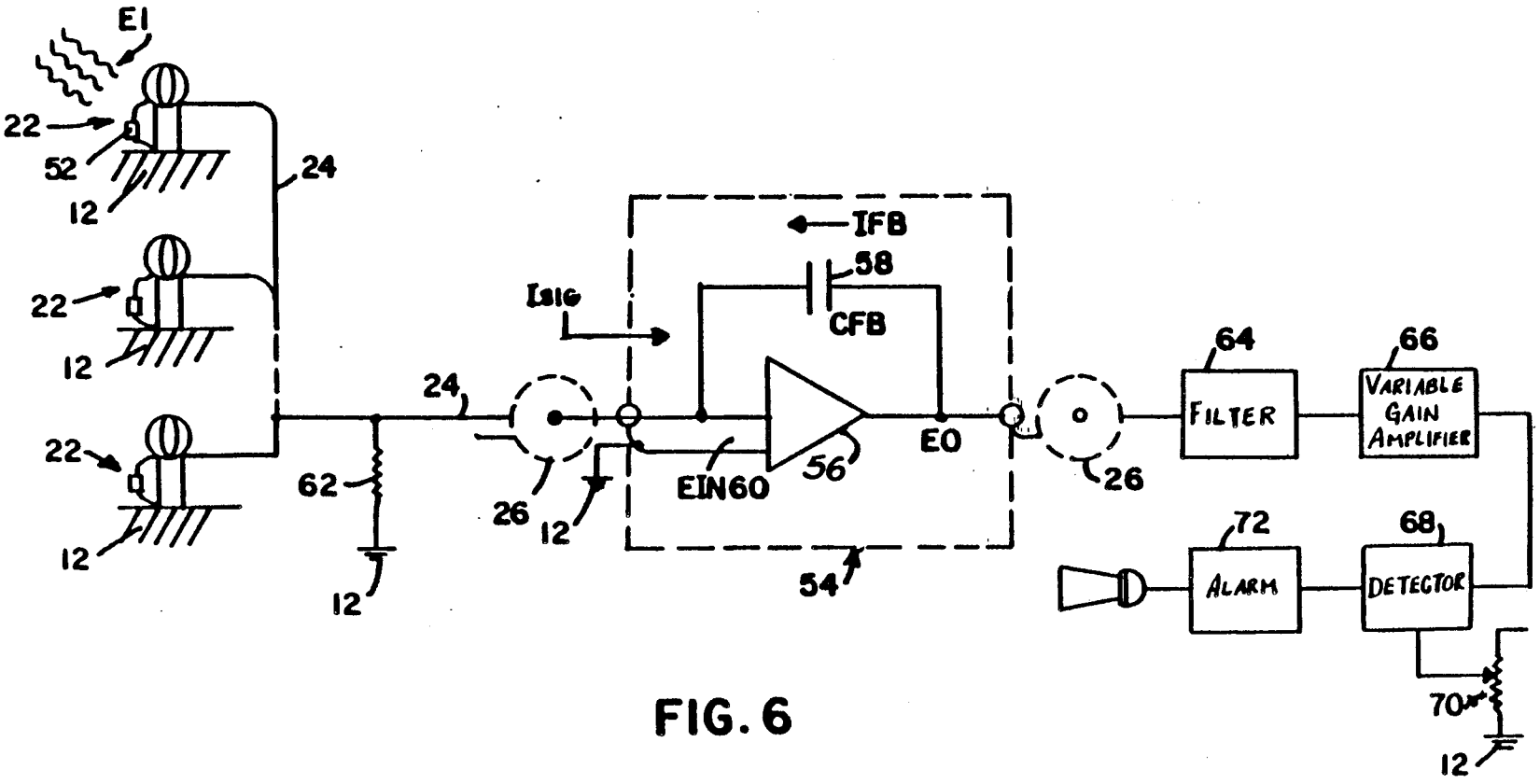
FIG. 6 is a circuit diagram of a system embodiment.

Referring now to FIG. 6, there is shown a method of summing signals from the individual sensors 22. A plurality of sensors 22 are mounted upon surfaces of crane boom 12. Note that the sensors 22 need not be identically sized or mounted at equal heights above the surfaces of boom 12 and therefore may have different characteristic capacitances. The sensors 22 are connected with wire 24 to capacitive summing amplifier 54. For very large cranes, the amplifier 54 may be mounted near the sensors so that the noise that would be picked up in wire 24 would be minimized. Take up reels 26 can be used as needed if the various positions of the boom or jib can extend relative each other. The wire 24 can be a single wire with the crane surface 12 acting as the ground return, or, wire 24 can be the shielded wire shown in FIG. 7.

The amplifier 54 comprises a high impedance transistor or integrated circuit amplifier 56 with high voltage gain and employes a capacitor 58 as a feedback impedance. The capacitor 58 should be of low leakage and have a low temperature cooefficient of capacity. Capacitors with polystyrene Teflon, Mylar or polypropylene dielectrics work well. The feedback current Ifb, produced by the output voltage Eo flowing through Cfb (capacitor 58) opposes the input current, Isig, from the sensors 22 as is well noted in Feedback Amplifier Theory. If the gain G, of amplifier 56 is high, then the currents Isig and Ifb are very nearly equal and opposite. The input voltage difference, Ein, 60, is very nearly zero. Since the input voltage 60 remains very low, the effective input impedance is very low. This allows resistors, such as leakage resistor 62 or the individual resistors 52 placed across the individual sensors 22 to have little effect on the output Eo. As an illustration, a practical gain for amplifier 56 may be 500,000 to 1,000,000, while capacitor 58 may be 0.01 microfarad. The effective input impedance 60 of amplifier 56 would be approximately $\frac{1}{3}$ ohm for a power line frequency of 60 Hertz. Thus, a leakage resistance 62 or sensor resistor 52 in the order of 1,000,000 ohms would have little effect since they are paralled with $\frac{1}{3}$ ohm effective input impedance.

The input current from a sensor 22*a* would be: $Ia = dQ/dt = C1 \times dE/dt$ where dQ/dt is the rate of change of the charge due to the electrostatic field present at sensor 22*a*. C1 is the capacity of the sensor 22*a* and is proportional to the effective area of the antenna relative to the crane mounting surface and inversely proportional to the dielectric constant of the insulating post and medium between the sensor and the surface.

The area of the post is generally much smaller than the area of the antenna and, if the medium between the antenna and surface is air, the effective dielectric constant is 1. If the area of the sensor is made larger, then the current Ia increases proportional to the field strength E1.

If the height of the sensor increases in a direction toward the flux field E1 then, although the capacity decreases, the field strength increases more rapidly and will increase Ia. The total current (Isig) from n sensors is:

$$Isig = \sum_{1}^{x} C1 \times dE1/dt + C2 \times dE2/dt + \ldots + Cn \times dEn/dt.$$

The feedback current Ifb=Cfb×dEo/dt. Since Isig is very nearly equal to Ifb, then;

$$Eo \approx \int (C1/Cfb) \times dE1/dt + (C2/Cfb) \times dE2/dt + \ldots + (Cn/Cfb) \times dEn/dt.$$

If the sensors were identical and if they were located in nearly equal electric fields then the output voltage Eo≈n×(C1/Cfb)×E1. In practice, however, the output current will largely be provided by the sensor with the highest field intensity which, generally, means the closest sensor to an energized wire.

Filtering of the output signal Eo is provided by filter circuitry 64 to remove spurious noise or harmonics, either higher or lower than the power line frequency and sent to variable gain amplifier 66 that can be preset for a desired sensitivity. The detector 68 rectifies the signal from 66 to produce a direct current voltage. This voltage is compared with a desired voltage 70 and, if it exceeds this voltage, triggers alarm 72.

Figure 7:
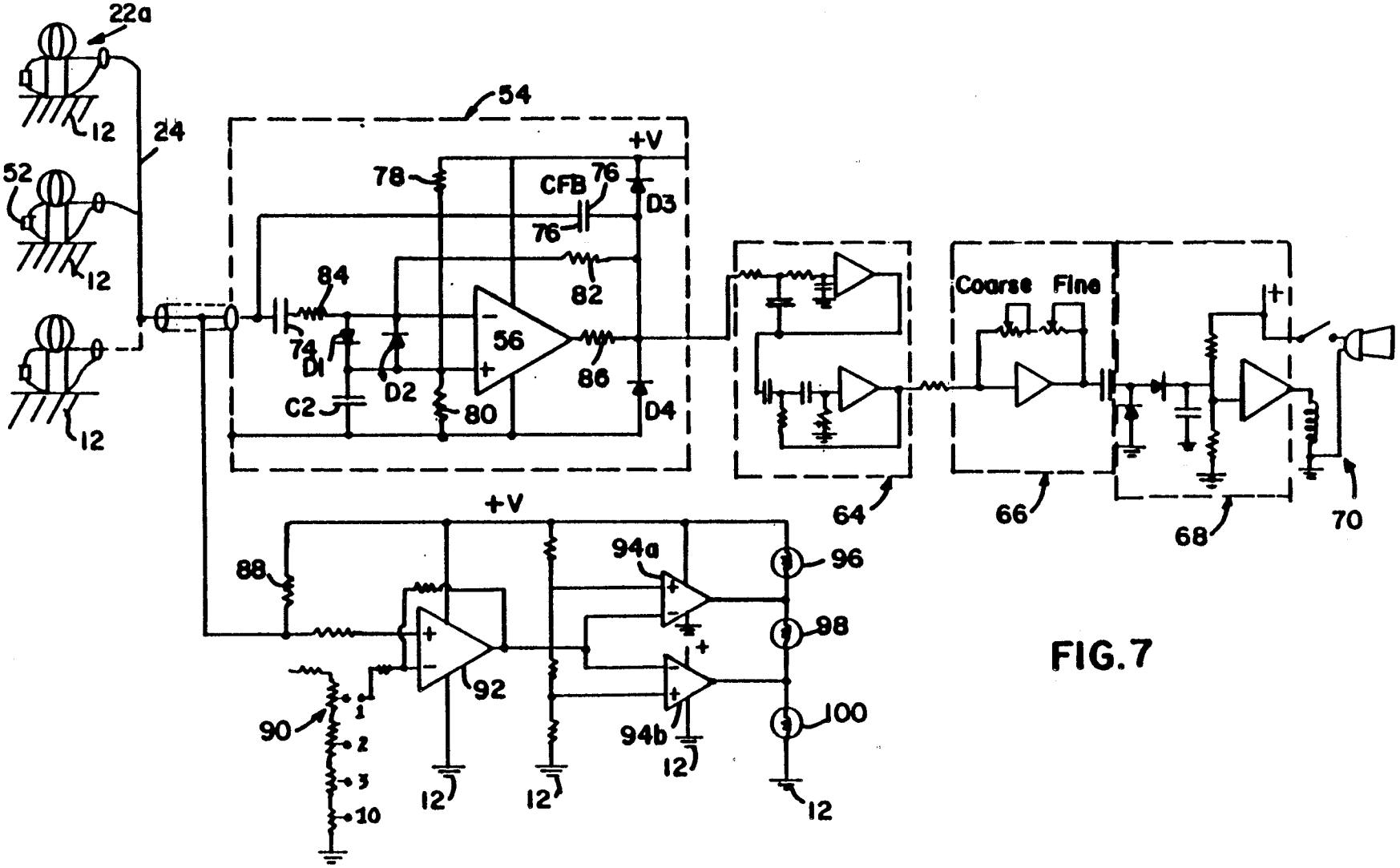
FIG. 7 is a circuit diagram of an alternate system embodiment

FIG. 7 shows the circuitry in greater detail and includes a method of determining if all sensors are present or if wire 24 is shorted or open. In amplifier 54 a capacitor 74 is included. Capacitor 74 will remove any DC voltage present on wire 24 but will pass the alternating current voltage from the flux field E1. Feedback capacitor 76 provides the feedback current Ifb as before. Resistors 78, 80 and 82 provide operating bias points for amplifier 56 while resistors 84 and 86 and diodes D1, D2, D3 and D4 provide protection for amplifier 56 from lightning transients, radio stations, ignition pulses, etc.

Resistor 88 is used to impress a DC voltage on wire 24. The value of this voltage on 24 is dependent on the number of resistors 52 shunting wire 24 to ground. Since a resistor 52 is a part of each sensor 22, this DC voltage is dependent on the number of sensors used. For instance, if resistors 88 and 52 are equal, and ten sensors are used, then the DC voltage on wire 24 is equal to 1/11(+v), etc. Switch 90 is set to a voltage equal to this DC voltage on wire 24. The output of the voltage comparator 92 will be ½(+v). If one or more sensors are disconnected, the DC voltage on wire 24 will increase and the output of the comparator will change. In a similar fashion, if wire 24 is shorted or broken, the voltage on wire 24 will be either lower or higher than the voltage at switch 90 and the output from 92 will be higher or lower than the preset value. Discriminators **94*a* and 94*b* can be used to tell if the input line is open or shorted or if the proper number of sensors are active by which of the indicators 96, 98 or 100** are illuminated.

While there have been shown what are at present considered to be the preferred embodiments of the invention, it will be apparent to those skilled in the art that various changes and modifications can be made herein without departing from the scope of the invention as defined by the appended claims.

I claim:

1. An electrostatic proximity sensor comprising: an electrically insulating body having first and second ends and first and second electrically conductive members, one at each of said ends; mounting means attached to said first end; an antenna connected to said second end; and a resistor electrically connected between said first end and said antenna.

2. The sensor of claim 1 wherein said antenna comprises a plurality of metal wires in the shape of a sphere.

3. The sensor of claim 1 wherein said antenna comprises an electrically conductive disc.

4. The sensor of claim 1 wherein said antenna comprises a plurality of wires arrayed in a plane normal to the longitudinal axis of said insulating body.

5. The alarm system of claim 1 wherein said resistor has a predetermined value.

6. An alarm system for sensing electrostatic fields in the area of an electrically conductive element comprising: a plurality of electrostatic field proximity sensors mounted upon said element, each of said sensors comprising an insulating body having first and second ends and first and second electrically conductive members, one at each of said ends; mounting means attached to said first end for attachment to said element; an antenna connected to said second end; and a resistor connected between said first end and said antenna; said sensors being arranged in sets about said element and being electrically connected in parallel; a capacitive summing amplifier coupled to said sensors; a filter coupled to said summing amplifier; a variable gain amplifier coupled to said filter; a detector coupled to said variable amplifier; and an alarm coupled to said detector.

7. The alarm system of claim 6 wherein said sensors are coupled to said summing amplifier via a shielded wire.

8. The alarm system of claim 7 wherein said electrically conductive element is a boom on a crane.

9. The alarm system of claim 8 wherein said boom is extendable and is provided with at least one take-up reel for said shielded wire.

10. The alarm system of claim 6 wherein at least one of said sensors is mounted at a different height from said boom than the other sensors.

11. A crane boom protective system comprising: a crane boom; a plurality of sensors, each having a characteristic capacitance, arranged about said boom, each of said sensors having an output connected to a single shielded wire, said sensors developing a charge when in the presence of an electrostatic field; and an amplifier containing capacitive feedback means connected to said shielded wire for the purpose of indicating the presence of a charge signal.

12. The system of claim 11 wherein said sensors have varying characteristic capacitances to provide varying sensitivities.

13. The system of claim 12 wherein said amplifier includes means to detect when its output exceeds preset limits.

14. The system of claim 13 wherein said detected output signals alarm means and produces an alarm.

* * * * *